US007409766B2

(12) United States Patent
Steigerwalt

(10) Patent No.: US 7,409,766 B2
(45) Date of Patent: Aug. 12, 2008

(54) FOLDING TOOL WITH BLADE LOCKING MECHANISM

(75) Inventor: Kenneth Steigerwalt, Orangeville, PA (US)

(73) Assignee: Mentor Group LLC, Oregon City, OR (US)

( * ) Notice: Subject to any disclaimer, the term of this patent is extended or adjusted under 35 U.S.C. 154(b) by 441 days.

(21) Appl. No.: 11/174,055

(22) Filed: Jul. 1, 2005

(65) Prior Publication Data

US 2006/0005397 A1 Jan. 12, 2006

Related U.S. Application Data

(60) Provisional application No. 60/586,967, filed on Jul. 8, 2004.

(51) Int. Cl.
*B26B 1/04* (2006.01)
*B26B 11/00* (2006.01)

(52) U.S. Cl. ..... 30/161; 30/152; 30/157; 7/118

(58) Field of Classification Search ..... 30/155, 30/158, 152, 161, 151, 342, 160, 330, 331; 7/118

See application file for complete search history.

(56) References Cited

U.S. PATENT DOCUMENTS

| | | | | |
|---|---|---|---|---|
| 201,931 | A * | 4/1878 | Martin | 30/408 |
| 569,103 | A * | 10/1896 | Jansen | 30/155 |
| 947,823 | A * | 2/1910 | Kinney | 30/155 |
| 4,502,221 | A | 3/1985 | Pittman | |
| 4,901,439 | A * | 2/1990 | Boyd, Jr. | 30/161 |
| 5,044,079 | A * | 9/1991 | Gibbs | 30/160 |
| 5,461,786 | A | 10/1995 | Miller | |
| 6,308,420 | B1 | 10/2001 | Moser | |
| 6,574,869 | B1 | 6/2003 | McHenry | |
| 6,651,344 | B2 | 11/2003 | Cheng | |
| 6,675,484 | B2 | 1/2004 | McHenry et al. | |
| 6,701,621 | B2 * | 3/2004 | Kain et al. | 30/160 |
| 6,732,436 | B2 | 5/2004 | Moizis | |
| 6,789,323 | B2 * | 9/2004 | Moizis | 30/155 |
| 7,086,157 | B2 | 8/2006 | Vallotton | |
| 7,293,360 | B2 | 11/2007 | Steigerwalt et al. | |
| 2001/0016987 | A1 * | 8/2001 | Chen | 30/161 |
| 2003/0208908 | A1 | 11/2003 | Kain et al. | |
| 2004/0148781 | A1 | 8/2004 | PerMar, Jr. | |
| 2004/0154170 | A1 * | 8/2004 | Kain et al. | 30/161 |
| 2004/0158991 | A1 | 8/2004 | Freeman | |
| 2005/0241154 | A1 | 11/2005 | Lake | |
| 2006/0059694 | A1 | 3/2006 | Carter, III | |
| 2006/0064877 | A1 | 3/2006 | Vallatton et al. | |
| 2007/0006466 | A1 * | 1/2007 | Ping | 30/152 |

OTHER PUBLICATIONS

U.S. Appl. No. 11/340,332, filed Jan. 2006, Steigerwalt.

* cited by examiner

*Primary Examiner*—Boyer D. Ashley
*Assistant Examiner*—Edward Landrum
(74) *Attorney, Agent, or Firm*—Hancock Hughey LLP

(57) ABSTRACT

A hand tool such as a multi-bladed folding knife incorporates a lock back mechanism t hat is interconnected with springs extending parallel to the knife body and with pins that interconnect the springs. The springs apply biasing force via the pins to the lock back mechanism associated with the primary blade, and also on secondary blades if used.

12 Claims, 3 Drawing Sheets

FOLDING TOOL WITH BLADE LOCKING MECHANISM

FIELD OF THE INVENTION

This invention relates to hand tools such as knives and multitools that incorporate folding implements, and more specifically to a blade or implement locking mechanism for use in such tools that facilitates secure locking of the implement in the open or extended position.

BACKGROUND

Many types of hand tools such as knives and multitools incorporate folding mechanisms that allow an implement to be moved between a folded position in which the implement is safely stowed in the tool handle, and an extended position in which the implement is ready for work. One typical example of such a folding tool is a knife having a folding blade. The knife handle typically has two opposed handle portions defining a blade-receiving groove. A blade pivots on a shaft attached to the handle such that in a folded position the blade is stowed with the cutting portion of the blade retained safely in the groove, and such that in an extended position the blade is extended away from the handle, ready for use. Foldable knifes are ubiquitous.

To increase the safety of folding tools such as knives, many such tools incorporate locking mechanisms of one type or another. When the knife blade pivots into the open position, it's pivotal movement is stopped with a blocking mechanism such as a transverse blade stop pin housed in the handle. Often a locking mechanism is included that prevents the blade from unintentionally pivoting back from the open into the closed position. There are many types of locking mechanisms. One common type is a "liner lock." This kind of mechanism relies upon a resilient lever formed as part of a handle liner. When the blade is pivoted to the open or extended position, the resilient lever engages a cooperatively formed shoulder on the blade and thereby locks the blade in the open position. Another typical locking mechanism is a cross-bolt mechanism such as that described in U.S. Pat. No. 5,822,866. As detailed in the '866 patent, which describes an automatic opening knife, the cross-bolt mechanism includes a locking body that has a cylindrically tapered side wall portion. When the blade is extended to the open position, the tapered side wall portion of the locking body is urged by a compression spring into a locking position in which the locking body wedges between an engagement surface on the blade and a bore in the handle to lock the blade in the open position.

There are other types of blade locks in addition to the locking mechanisms just described. Another common type of locking mechanism is called a "lock back" mechanism. While there are variations in the structure for a lock back, in most lock back mechanisms a latch bar held between the handles at the upward side thereof pivots on a pivot pin extending through the latch bar and having opposite ends connected to the handle halves. When the blade or other implement is in the extended position, a spring mounted in the rearward portion of the handle (between the handle halves) applies upwardly directed pressure on the latch bar rearward of the pivot, urging the forward end of the latch bar—that is, the end of the latch bar on the opposite side of the pivot pin from the spring—into a locking engagement with the blade. The forward end of the latch pin typically includes a portion that engages a notch in the blade tang. The blade is unlocked by pushing downwardly on the rearward end of the latch pin at a notch in the handles—against the spring force, to cause the forward end of the latch bar to pivot upwardly and disengage the blade tang. It will be appreciated that a significant amount of space is required to house the springs and associated structures used to drive such lock back mechanisms.

A very traditional multi-bladed folding knife known as the "Whittler Pattern" has three blades: a single primary cutting blade on one end, and two secondary blades on the other end. While these knives have been manufactured for many years, given structural constraints it has been difficult to make such knives with reliable locking mechanisms for the primary cutting blade.

There is a need therefore for improved locking mechanisms for folding hand tools, and in particular improved lock back mechanisms. Lock back mechanisms for multi-blade folders such as the Whittler Pattern are needed.

The present invention relates to a hand tool—typically embodied as a knife—that incorporates a lock back-type locking mechanism for securely locking the implement such as a blade in the open position, and for releasing the lock to allow the implement to be folded back into the closed position.

BRIEF DESCRIPTION OF THE DRAWINGS

The invention will be better understood and its numerous objects and advantages will be apparent by reference to the following detailed description of the invention when taken in conjunction with the following drawings.

In FIG. 1 the knife blades are all stowed in the closed or folded position.

In FIG. 5, two blades shown in their fully extended positions and one blade is shown in two different positions to illustrate operation of a spring.

DETAILED DESCRIPTION OF THE PREFERRED EMBODIMENTS

A preferred embodiment of a hand tool 10 incorporating a locking mechanism in accordance with the illustrated invention is shown in the figures. Although the invention is described with respect to its embodiment in a particular type of tool—a knife—and even then a particular type of knife—a multi-bladed knife—it will be appreciated that references to this type of a knife, and indeed this particular type of hand tool, are for illustrative purposes to describe the invention. Those of ordinary skill in the art will appreciate that the invention claimed herein is not limited to knives, but instead extends to any hand tool having the features claimed herein.

Figure 1:
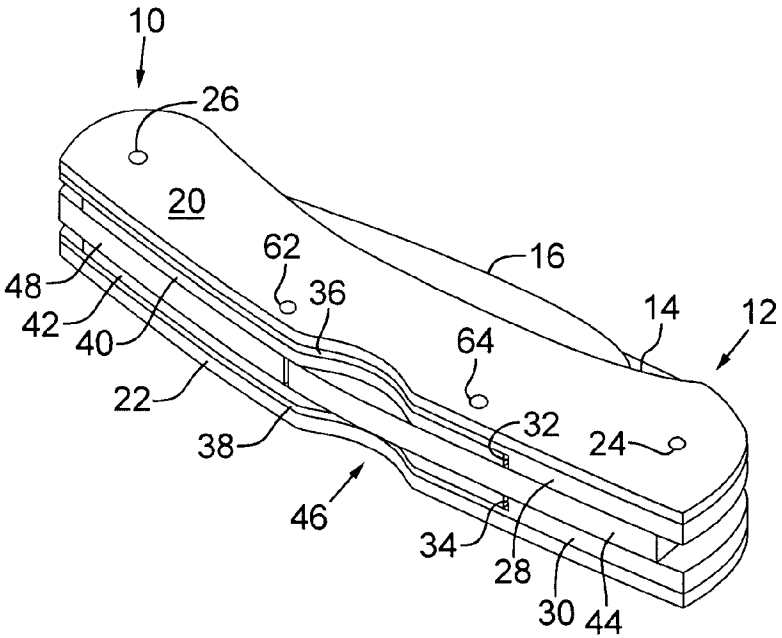
FIG. 1 is a perspective view of a hand tool—in this case a multi-blade folding knife—that is exemplary of the type of hand tool that incorporates a lock back mechanism according to the present invention.
Figure 2:
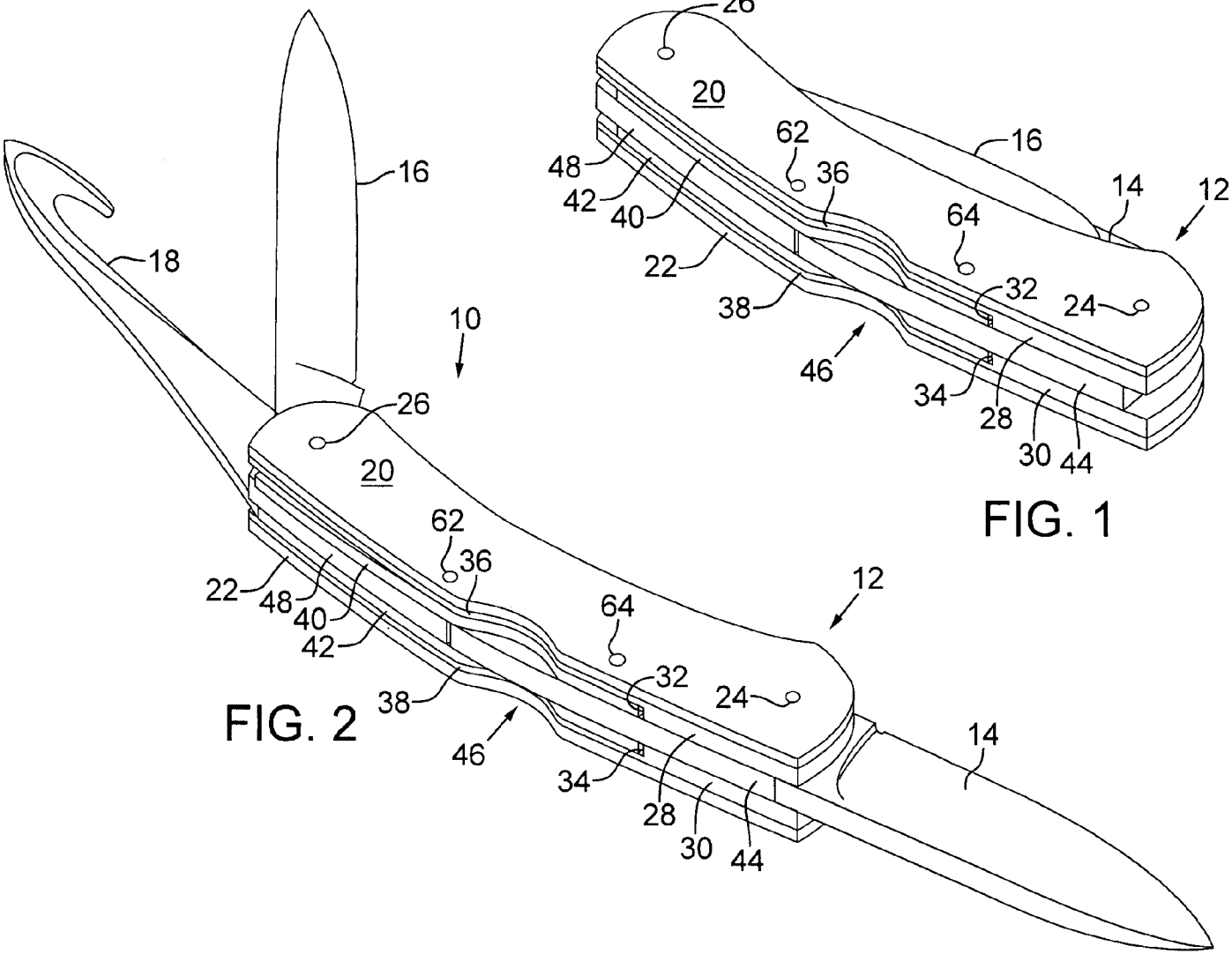
FIG. 2 is a perspective view of the knife shown in FIG. 1 with the three blades in the fully extended or open positions, or in an intermediate position.

With particular reference now to FIGS. 1 and 2, knife 10 includes a handle 12 and three blades 14, 16 and 18. The knife 10 shown in the figures is a traditional Whittler Pattern—a multi-blade folding knife that has one primary cutting blade at one end, and two secondary blades at the other end. Handle 12 includes two side wall portions or handle halves 20 and 22 that are held parallel to one another in a spaced apart relationship with various screws and the like to define a blade receiving groove therebetween for receiving blades 14, 16 and 18 when they are folded into the closed position as seen in FIG. 2. Each of the blades 14, 16 and 18 is pivotally attached to the handle so that the blades are pivotal between the open position of FIG. 1 and the closed position of FIG. 2. Specifically, blade 14 is pivotally attached to handle 12 with a pivot shaft 24 that has its opposite ends fixed to the handle halves. Likewise, blades 16 and 18 are pivotally attached to handle 12 with a common pivot shaft 26 that has its opposite ends fixed to the handle halves at the opposite end of the handle from pivot shaft 24. Appropriate spacers are incorporated into knife 10 to define separate blade receiving slots in handle 10 to accommodate the three blades in their folded position, as detailed below. It will be appreciated that blades 16 and 18 pivot between their open and closed positions in the opposite direction from blade 14. When the three blades 14, 16 and 18 are in the closed or retracted positions shown in FIG. 2, the working portions of the blades are safely stowed in the blade-receiving grooves in the handle 12, with blade 14 nested between blades 16 and 18.

As detailed below, blade 14 is the only blade in knife 10 that may be locked with the locking mechanism according to the illustrated invention. As such, blade 14 is sometimes referred to as the "primary blade." Blades 16 and 18 are sometimes referred to as "secondary" or "minor" blades. It will be appreciated that the type of blades shown in the figures (i.e., blades 14 and 16 are conventional knife blades and blade 18 is a conventional gut hook blade) are for illustrative purposes, and the invention is not limited to use with any particular type of blade or implement. As used herein, relative directional terms such as forward refer to the end of the knife on which primary blade 14 is mounted. "Rearward" is therefore the opposite longitudinal end of knife 10 where blades 16 and 18 are mounted.

Immediately inward of the handle halves 20 and 22 are liners 28 and 30. Liner 28 is positioned next to handle half 20 and is thus sandwiched between handle half 20 and other structures described below. Similarly, liner 30 is positioned next to handle half 22 and is sandwiched between handle half 22 and other structures.

Both liners 28 and 30 have stepped down portions at the areas identified with reference numbers 32 and 34, respectively. These stepped down portions result in relatively thinner sections of the liners, identified with reference numbers 36 and 38, rearward of the stepped down portions 32 and 34. The relatively thinner liner sections are for receiving spring members 40 and 42. It will be understood that the stepped down portions may be formed by removing material from the liners, or by using thicker, separate spacers to define the thicker, forward end of the liners. The structure and function of spring members 40 and 42 will be explained in greater detail below. Both spring members are fabricated from a resilient material such as titanium or tempered steel to provide biasing force on blades 16 and 18, and also a biasing force for use with the lock back mechanism.

A lock bar 44 is positioned intermediately between handle half 12, liner 28 and spring member 40 on the one side, and handle half 14, liner 30 and spring member 42 on the opposite side. Each of the handle halves 12 and 14, the liners 28 and 30, and the spring members 40 and 42 are cut out at a notched section 46 to expose lock bar 44 and allow its use to lock and unlock primary blade 14. A spacer bar 48 is mounted in an intermediate position rearward of lock bar 44. Lock bar 44 is not notched in the notched section 46.

Figure 3:
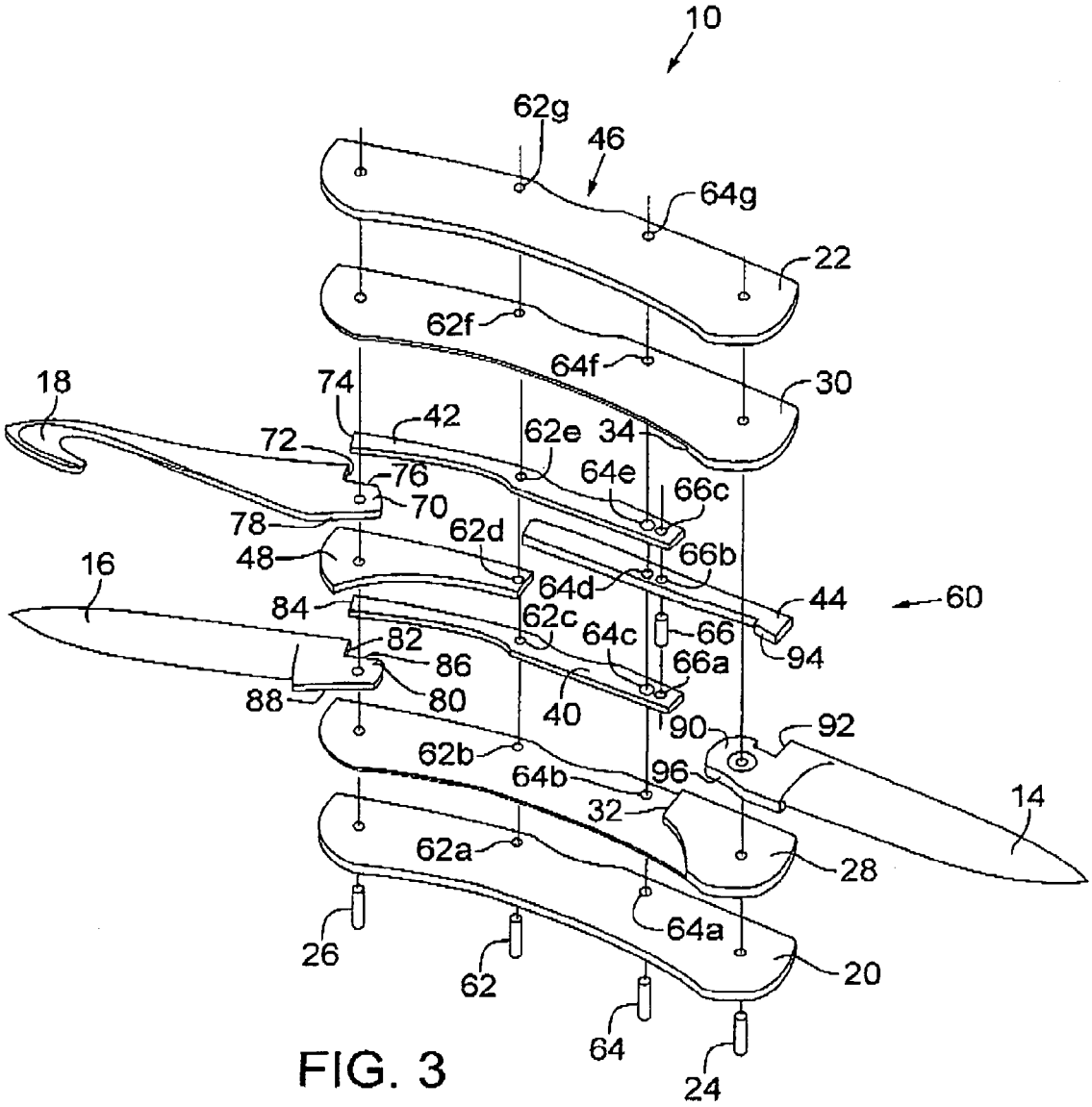
FIG. 3 is an exploded perspective view of the knife shown in FIG. 1, illustrating some of the component parts.

Reference is now made to the exploded view of knife 10 shown in FIG. 3 where it may be seen that the pivot shafts 24 and 26 extend through bores formed cooperatively in the various component layers of knife 10. Pivot shaft 24 thus extends through bores formed in handle half 20, liner 28, blade 14, liner 30 and handle half 22. Similarly, pivot shaft 26 extends through bores formed in handle half 20, liner 28, blade 16, spacer bar 48, blade 18, liner 30 and handle half 22. The bores in these components are shown in the drawings but are not identified with reference numbers; it will be understood that when the components shown in FIG. 3 are assembled into the finished knife 10 as shown in FIG. 1, all of the bores align so that the pivot shafts extend through the aligned bores. The pivot shafts assist in holding the knife components together in a conventional manner, and may for example be threaded on one end if desired.

The locking mechanism that is incorporated into knife 10 and which locks primary blade 14 in the open position is identified generally as locking mechanism, or lock back mechanism 60, and is comprised of several structural components including springs 40 and 42, lock bar 44, and the pins that mount these structures to the knife.

Spring members 40 and 42 extend along the upper or "spine" edge of knife 10 and are mounted in place with several pins beginning with first pin 62, which in assembled knife 10 extends through bore 62*a* in handle half 20, bore 62*b* in liner 28, bore 62*c* in spring member 40, bore 62*d* in spacer bar 48, bore 62*e* in spring member 42, bore 62*f* in liner 30, and finally bore 62*g* in handle half 22. A second, forward mounting pin, referred to herein as second pin 64 or lock bar pivot pin 64, extends through springs 40 and 42 in a position toward the opposite end of the springs—that is, toward the forward end of the knife 10. Thus, lock bar pivot pin 64 in assembled knife 10 extends through bore 64*a* in handle half 20, bore 64*b* in liner 28, bore 64*c* in spring member 40, bore 64*d* in lock bar 44, bore 64*e* in spring member 42, bore 64*f* in liner 30, and finally bore 64*g* in handle half 22. Although in the illustrated embodiments first and second pins 62 and 64 have opposite ends extending into handle halves 20 and 22, these pins need not extend into the handle halves and may instead have their opposite ends extend into or resident in the bores in the liners 30 and 32.

Bore 62*c* in spring member 40, and bore 62*e* in spring member 42 are sized so that the diameter of the bores is only very slightly greater than the diameter of pins 62 and 64, respectively to allow the pins to be tightly inserted into the bores. As such, the pins will slide into the bores to facilitate assembly of the knife 10, but there is a close tolerance between the outer surface of the pins and the bores.

Bore 64*c* in spring member 40 and bore 64*e* in spring member 42 are formed so the diameter of these bores is oversized relative to the outer diameter of lock bar pivot pin 64. Thus, the diameter of bores 64*c* and 64*e* formed in spring members 40 and 42, respectively is greater than the outer diameter of lock bar pivot pin 64 where the pin extends through these bores, resulting in a relatively greater tolerance (i.e., space) between the outer circumference of pin 64 and the sides of bores 64*c* and 64*e*. As a result, the lock bar pivot pin 64 has some "float" or room for movement in bores 64*c* and 64*e*. As detailed below, this allows the lock bar 44 to operate. The bores 64*c* and 64*e* are preferably about 0.032 inches greater in diameter than the outer circumference of lock bar pivot pin 64, although the amount of oversizing may be varied without adversely effecting operation of lock mechanism 60. As an example, the bores 64*c* and 64*e* could be oval in shape to allow the pin to move in the bores. Bore 64*d* in lock bar 44 is the same diameter as pin 64 so there is a close tolerance between lock bar pivot pin 64 and lock bar 44.

Lock bar 44 is mounted in knife 10 between spring members 40 and 42 with a connector pin 66 that is located forward of lock bar pivot pin 64. Connector pin 66 extends through a bore 66*b* in lock bar 44 and has its opposite ends extending into bores formed in spring members 40 and 42, respectively. Thus, one end of connector pin 66 extends into bore 66*a* in spring member 40 and the opposite end of connector pin extends into bore 66*c* in spring member 42. Both bores 66*a* and 66*c* are drilled so the diameter of the bores is only very slightly greater than the diameter of connector pin 66. The diameter of bore 66*b* in lock bar 44, through which connector pin 66 extends, is likewise only very slightly greater than the diameter of the connector pin 66. As such, the connector pin 66 slides through the bore 66*b* during assembly of knife 10, yet there is a close tolerance between the pin and the bores. As a result, spring tension from spring members 40 and 42 is transmitted directly to lock bar 44 via connector pin 66, and movement of lock bar 44 as described below directly causes movement of the spring members.

The spring members 40 and 42 are mounted in handle 12 so that the spring members constantly apply biasing force against adjacent structures in the "downward" direction—that is, the direction moving from the spine of the knife 10 toward the knife receiving slot on the opposite side of the knife. Spring members 40 and 42 are thus compressed during assembly of the knife when pin 62 is inserted into the associated bores and is connected to the liners and handles. Pin 62 thus maintains the spring members in a state of constant compression so that biasing force is applied by the spring members on the blades and as detailed herein, on the lock bar 44. If knife 10 were assembled without the secondary blades, the spring members could be compressed by fixing the rearward ends of the spring members (as with pins and the like) when the spring members are assembled with pin 62.

Figure 4:
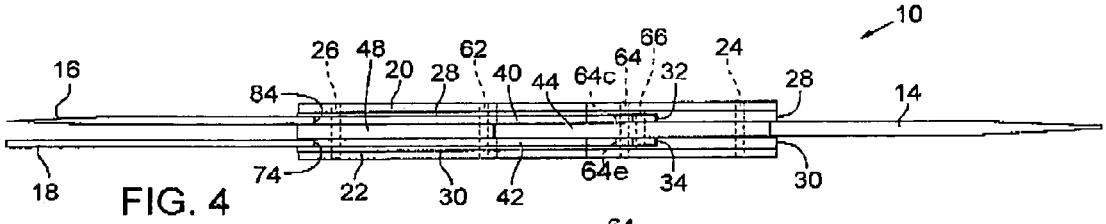
FIG. 4 is a top plan view of the knife shown in FIG. 1 with the three blades extended into their open positions.

With continuing reference to FIG. 3, the tang portion 70 of blade 18 has a notched shoulder portion 72 that is cooperatively shaped to receive the rearward end 74 of spring member 42 when blade 18 is in the open position. As best seen in FIG. 4, when blade 18 is in the open position, shoulder 72 on blade 16 abuts rearward end 74 of spring member 42 to stop rotation of the blade in the fully open position. Returning to FIG. 3, flattened portion 76 of tang 70 underlies spring member 42 partially along the length of the spring member near the rearward end.

Similarly, the tang portion 80 of blade 16 has a notched shoulder portion 82 that is cooperatively shaped to receive the rearward end 84 of spring member 40 when blade 16 is in the open position. Again referring to FIG. 4, when blade 16 is in the open position, shoulder 82 on blade 16 abuts rearward end 84 of spring member 40 to stop rotation of the blade in the fully open position. A flattened portion 86 of tang 80 underlies spring member 40 partially along the length of the spring member near the rearward end.

As noted above, spring members 40 and 42 are mounted in handle 12 so that the spring members constantly apply biasing force on the blades. With reference to blades 16 and 18, when the blades are in the open position springs 40 and 42 apply spring force to the blades at the interface between the springs and the flattened portions of the tangs, 76 and 86, respectively.

The biasing force applied by spring members 40 and 42 to blades 16 and 18 helps to hold the blades in both their open and closed positions. As noted earlier, a flattened portion 76 of tang 70 underlies spring member 40 when blade 16 is in the open position. In this position, spring member 40 applies biasing force against the blade. The combination of the spring force applied by spring member 40 with the abutting relationship between rearward end 74 of spring member 40 in notch 72, retains blade 16 in the open position.

Figure 5:
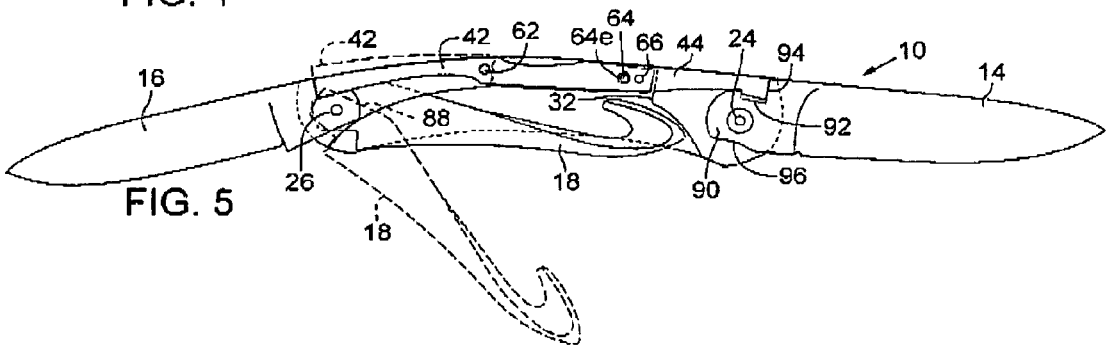
FIG. 5 is a side elevation view of the knife shown in FIG. 4 with the knife handle and liner on the near side shown in phantom lines to illustrate the internal structures of the knife.
Figure 6:
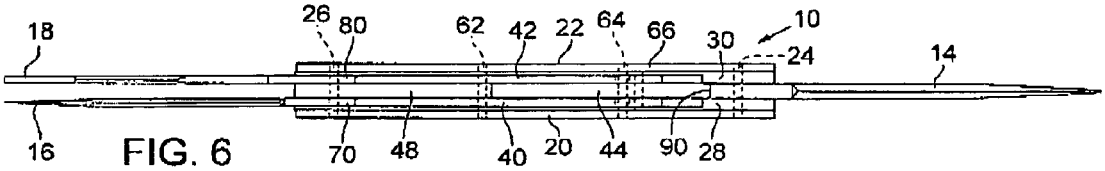
FIG. 6 is a bottom plan view of the knife shown in FIG. 4 with the three blades extended into their open positions.

Blade 16 may be moved to the closed position by rotating it about pivot shaft 26 (e.g., rotating blade 16 in the counterclockwise direction in FIG. 5). As this is done and tang 70 rotates, the flattened portion 76 of tang 70 pushes upwardly against the rearward end of spring member 40. As the blade continues its rotation in this closing direction, the tang continues to push against the spring member, deflecting the spring member 40 upwardly about pin 62 and thereby "loading" the spring with greater force. Stated another way, the spring member is applying greater biasing force on the blade as it is rotated and the spring member is deflected away from its resting position. The deflection of spring 40 when blade 16 is in an intermediate position between fully opened and fully closed is shown in FIG. 1. As the rotation continues, the lower edge of tang 70 passes the spring member, resulting in spring force urging the blade 16 into the closed position. When blade 16 is fully rotated to the closed position, spring member 40 rests against and applies force to flattened portion 78 of tang 70, thereby retaining blade 16 in the closed position. The force applied by spring member 40 helps to retain the blade in the closed position.

Spring member 42 acts on blade 18 in an identical manner to that just described with respect to spring member 40 acting on blade 16. FIG. 5 illustrates blade 18 in an intermediate position in phantom lines, with the resulting deflection of spring member 42, and with blade 18 in the fully closed position in solid lines, with flattened portion 88 of tang 80 resting against and abutting spring member 42.

The tang 90 of primary blade 14 includes a notch 92 into which a cooperatively shaped tooth 94 on the forward end of lock bar 44 fits. As best shown in FIG. 5, when blade 14 is in the fully open or extended position, tooth 94 is received into and engages notch 92 in tang 90, the lock bar thus both stopping rotation of blade 14 in the fully open position where the forward end of the lock bar abuts the rearward facing surface of the knife tang, and locking the blade in this position with tooth 94 and preventing the blade from being rotated from the open and locked position toward the closed position. It will be appreciated that the geometric configuration of the tooth and receiving notch may take on many different forms so long as the tooth is received positively in the notch to lock the blade.

Operation of lock back mechanism 60 will now be detailed. When primary blade 14 is in the closed position, tooth 94 on the forward end of lock bar 44 presses against and is urged with spring force against flattened portion 96 on tang 90. The forward end of the lock bar 44 is under the biasing force applied to the lock bar by both spring members 40 and 42 by virtue of connector pin 66—as noted, when the knife is assembled the spring members 40 and 42 apply constant spring pressure to the associated structures. The biasing force is applied downwardly on the forward end of the lock bar. That is, tooth 94 is urged against flattened portion 96 of tang 90 and therefore retains the blade 14 in the closed position under spring force. Blade 14 may be rotated from the closed position to the open position by grasping the exposed portion of the blade and rotating it. As the blade rotates, tooth 94 of lock bar 44 rides over tang 90 and the lock bar is thus deflected against the biasing force applied by spring members 40 and 42 at the direct connection between the lock bar 44 with springs 40 and 42 through connector pin 66. When the blade 14 is rotated to the fully open position, tooth 94 is urged into notch 92, again under the force applied to the lock bar by the spring members. When tooth 94 is received into notch 92, the blade 14 is locked in the open position and may not be rotated in either direction.

Locking mechanism 60 is unlocked to allow blade 14 to be rotated from open to closed by depressing lock bar 44 in the notched section 46 of handle 12. When lock bar 44 is depressed in notched section 16, the lock bar pivots about lock bar pivot pin 64—the forward end of the lock bar moves upwardly until tooth 94 disengages from notch 92. Because bores 64*c* and 64*e* in spring members 40 and 42 are oversized, as the lock bar 44 pivots about lock bar pivot pin 64, the connector pin 66 moves directly with the lock bar very slightly in the upward direction. However, the lock bar pivot pin 64 does not make contact with the spring members where the pin passes through the oversized bores 64*c* and 64*e* in the spring members. The oversized bores formed in the spring members thus allow the lock bar 44 to move in an up and down direction relative to the handle as the lock bar is depressed at notched section 46.

Stated another way, the diameter of the bores 64*c* and 64*e* is larger than the diameter of the lock bar pivot pin 64, and as the lock bar pivots about the lock bar pivot pin 64, the spring member 40 and 42 apply spring force to the lock bar by virtue of direct connection between the lock bar and the springs with lock bar connector pin 66, but the lock bar pivot pin 64 does not contact either spring member due to the clearance in the bores.

Once tooth 94 is disengaged from notch 92, primary blade 14 may be rotated to the closed position.

The linear distance between lock bar pivot pin 64 and connector pin 66 may be varied to vary the force necessary to pivot lock bar 44. Thus, by increasing the distance between the axis through pins 64 and 66, the amount of force required to pivot lock bar 44 increases. Conversely, by moving the pins closer together, the force necessary to activate the lock bar decreases. The amount of spring force applied by spring members 40 and 42 may likewise be varied by varying the physical characteristics of the materials used to fabricate the springs. For example, the relative "strength" of the springs may be changed by using different metals, or by changing the thickness of the springs.

It will be appreciated that the mechanism described herein and illustrated in the figures applies downward, locking force on the lock bar 44 by the spring members urging the forward end of the lock bar, forward of the connector pin 66. This structure allows the rearward end of the knife to be relatively free from other structures that might be associated with more conventional lock back mechanisms, and thus allows, for example, inclusion of the two minor blades 16 and 18 at the rearward end of the knife. The lock back mechanism 60 therefore allows for a reliable lock for the primary blade in a Whittler Pattern knife.

It will also be appreciated that various design modifications may be made without departing from the nature and scope of the invention. For example, the two minor blades 16 and 18 may be omitted and the springs 40 and 42 may in that case be supported at their rearward ends by the liners and/or the spacer bar. Moreover, while the handle 12 of knife 10 preferably includes liners 28 and 30 as separate pieces, the handle 12 may be manufactured without separate liners. Accordingly, the knife term "handle" as used herein contemplates a handle with liners, and a handle without liners. Finally, it will be appreciated that structure of the spring members may be varied from the form described herein and shown in the drawing figures. As one example, the liner members may be cut longitudinally from the forward end toward the rearward end to define spring members in the liners themselves—the forward end of the cut is open and the rearward end of the cut is closed to define a spring. This allows each spring member and liner to be fabricated from a single piece of material.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. A folding knife, comprising:

a handle having first and second opposed side walls held in a spaced-apart arrangement to define a slot therebetween;

a first blade having a working portion and a tang portion pivotally attached to the handle, said first blade movable between a closed position and an open position;

a first spring member disposed between the first blade and one of said side walls, and a second spring member disposed between the first blade and the other of said side walls;

a lock bar disposed between said first and second spring members, said lock bar having a first blade engaging surface on a first end for locking the blade in the open position; and a first pin with opposite ends extending into said handles and extending through bores in said spring members and said lock bar, wherein the diameter of the bores in said spring members is greater than the diameter of said first pin and said lock bar is pivotal about said first pin, and a second pin with opposite ends extending to said spring members and extending through a bore in said lock bar between said first pin and said first end of said lock bar;

wherein said spring members apply biasing pressure to said lock bar and exert pressure on the first blade engaging surface of said lock bar through the interconnection between said spring members and said lock bar with said second pin.

2. The folding knife according to claim 1 further including second and third blades, each having a working portion and a tang portion, said second and third blades pivotally attached to the handle at the opposite end from the first blade and movable between open and closed positions, wherein said first blade lies between said second and third blades when said first, second and third blades are in the closed position.

3. The folding knife according to claim 2 wherein a rearward end of said first spring member makes contact with the tang portion of said second blade and exerts pressure thereon.

4. The folding knife according to claim 2 wherein a rearward end of said second spring member makes contact with the tang portion of said third blade and exerts pressure thereon.

5. The folding knife according to claim 1 wherein said first blade engaging surface locks said first blade in said open position, and wherein said lock bar may be pivoted about said first pin to unlock said first blade to allow said first blade to be moved to said closed position.

6. The folding knife according to claim 1 wherein when said lock bar is pivoted about said first pin, said first pin does not make contact with said spring members.

7. A folding knife, comprising:

a handle having first and second opposed side walls held in a spaced-apart arrangement to define a slot therebetween;

a first blade having a working portion and a tang portion pivotally attached to the handle, said first blade movable between a closed position and an open position;

second and third blades, each having a working portion and a tang portion, said second and third blades pivotally attached to the handle at the opposite end from the first blade and movable between open and closed positions, wherein said first blade lies between said second and third blades when said first, second and third blades are in the closed position a first spring member disposed between the first blade and one of said side walls, and a second spring member disposed between the first blade and the other of said side walls;

a lock bar disposed between said first and second spring members, said lock bar having a first blade engaging surface on a first end for locking the blade in the open position;

a first pin with opposite ends extending into said handles and extending through bores in said spring members and said lock bar, wherein the diameter of the bores in said springs is greater than the diameter of said first pin, and a second pin with opposite ends extending to said spring members and extending through a bore in said lock bar between said first pin and said first end of said lock bar; and wherein said spring members apply biasing pressure to said lock bar and a rearward end of said first spring member makes contact with the tang portion of said second blade and exerts pressure thereon.

8. The folding knife according to claim 7 wherein a rearward end of said second spring member makes contact with the tang portion of said third blade and exerts pressure thereon.

9. The folding knife according to claim 7 wherein said spring members exert pressure on the first blade engaging surface of said lock bar through the interconnection between said spring members and said lock bar with said second pin.

10. The folding knife according to claim 9 wherein said lock bar is pivotal about said first pin.

11. The folding knife according to claim 10 wherein said first blade engaged surface locks said first blade in said open position, and wherein said lock bar may be pivoted about said first pin to unlock said first blade to allow said first blade to be moved to said closed position.

12. The folding knife according to claim 11 wherein when said lock bar is pivoted about said first pin, said first pin does not make contact with said spring members.

* * * * *